US005174175A

United States Patent [19]

Bouligny

[11] Patent Number: 5,174,175

[45] Date of Patent: Dec. 29, 1992

[54] ACTUATOR FOR ROTATABLE CLAMPING APPARATUS

[75] Inventor: Vernon J. Bouligny, New Iberia, La.

[73] Assignee: Frank's Casing Crew & Rental Tools, Inc., Lafayette, La.

[21] Appl. No.: 606,706

[22] Filed: Oct. 31, 1990

[51] Int. Cl.[5] ..... B25B 13/50

[52] U.S. Cl. ..... 81/57.33; 81/57.19; 81/57.44

[58] Field of Search ..... 81/57.19, 57.33, 57.44

[56] References Cited

U.S. PATENT DOCUMENTS

| | | | |
|---|---|---|---|
| 3,696,872 | 10/1972 | Jonsson | 81/57.19 X |
| 4,732,061 | 3/1988 | Dinsdale | 81/57.19 X |
| 4,811,635 | 3/1989 | Falgout, Sr. | 81/57.33 |

*Primary Examiner*—James G. Smith

*Attorney, Agent, or Firm*—Matthews and Assoc.

[57] ABSTRACT

A fluid actuator for a hydraulically powered rotatable gripping device which combines a fluid pressure or force multiplication with the capability of a physical separation of the rotating jaws and the fluid power source to permit rotation of the jaws and any gripped object while maintaining clamping or gripping pressure.

14 Claims, 3 Drawing Sheets

ACTUATOR FOR ROTATABLE CLAMPING APPARATUS

This application is related to application Ser. No. 07/394,949 filed Aug. 17, 1989 entitled Friction Grip for Tubular Goods, now U.S. Pat. No. 4,989,909, filed on Oct. 19, 1990 entitled Improved Torque Transfer Apparatus.

BACKGROUND OF THE INVENTION

The invention relates to the general field of power apparatus for coupling and uncoupling threaded joints in articles of equipment or long pipe sections In assembling a string of tubing for an oil well a long series of pipe sections are screwed together usually by means of power tongs. In devices for screwing together pipes which after a termination of the boring operation are drawn into the bore hole for casing an earth bore it is known to use a unit consisting of a screw-in clamp and a counter device which can be used in either suspended execution, i.e. suspended on a cable or in a stationary execution.

Hydraulically biased jaws on power tong are known in the art, see for example U.S. Pat. Nos. 3,796,418, 3,921,473, 4,057,887, 4,402,293, and 4,712,284.

Although it is known in the art to use hydraulically powered jaws until now it has been necessary to alternately connect and disconnect the hydraulic power source from the power jaws to permit rotation of the jaws during the screwing and unscrewing actions (see U.S. Pat. No. 4,712,284 to Coyle, Sr. et al). The present invention provides an apparatus eliminating the need to couple and uncouple the hydraulic source from the jaws. In addition, the present invention provides for modifying the fluid pressure to obtain a multiplication of the available fluid pressure which is particularly useful for certain improved types of gripping apparatus such as that described in U.S. Pat. No. 4,989,909. The hydraulic power sources commonly available around many power tong applications do not provide high enough fluid pressures for certain improved gripping devices which are desirable because they are more protective of the expensive tubing used in some applications.

This invention therefore provides a novel fluid actuator for a hydraulically powered gripping device which combines a fluid pressure or force multiplication with the capability of a physical separation of the rotating jaws and the fluid power source to permit rotation of the jaws and any gripped object while maintaining clamping or gripping pressure.

SUMMARY OF THE INVENTION

According to the present invention a hydraulically powered rotatable gripping apparatus is provided with an actuator comprising a first hydraulic cylinder connected in fluid communication to a hydraulic fluid power source. Mounted to and rotatable with the gripping jaws is a second hydraulic cylinder connected in fluid communication with the hydraulically powered gripping device. The first hydraulic cylinder is mounted to a frame or cage so that it is possible to align the two hydraulic cylinders so that the rams or pistons of the hydraulic cylinders are in longitudinal coaxial alignment, and so the free ends of the pistons will abut one another. Mounted intermediate in the fluid path connecting the second hydraulic cylinder and the gripping device is a check valve, and a bypass circuit and manual valve in parallel with the check valve. The second hydraulic cylinder is also provided with an internal spring which is mounted so as to urge the piston to extend.

The actuator is operated by aligning the first and second hydraulic cylinders, supplying hydraulic fluid under pressure to the first hydraulic cylinder which extends the piston ram so that when the two cylinders are aligned the extension of the ram of the first hydraulic cylinder will compress the ram or piston of the second hydraulic cylinder, compressing the spring mounted internally within the second hydraulic cylinder and forcing the hydraulic fluid from the second hydraulic cylinder through the fluid path so as to actuate the gripping or clamping device. The check valve operates to prevent a release of the fluid pressure supply to the clamping apparatus so that the hydraulic pressure supplied to the first cylinder can be released allowing the piston ram to move free from its abutting relationship with the ram of the second hydraulic cylinder to provide clearance for rotation of the jaws and second cylinder. The check valve holds the pressure of the gripping elements and the second piston ram remains compressed, and the second hydraulic cylinder and clamping device can be rotated as desired along with any work piece held gripped by the jaws.

After the rotation is completed, the bypass relief valve is opened, and the spring mounted within the second hydraulic cylinder extends the ram as the gripping or clamping pressure is released, and as the ram is extended by the spring, fluid is drawn from the fluid path connecting a second hydraulic cylinder and the gripping device, and in certain embodiments from the gripping device itself, depending upon the configuration of the gripping device.

The invention may also be set or configured to provide a multiplication of the fluid pressure available from the hydraulic fluid power source by means of sizing the first hydraulic cylinder to a proportionately greater diameter than the second hydraulic cylinder to obtain a proportionate multiplication of the fluid pressure where that is desirable or necessary for the operation of the gripping devices.

DETAILED DESCRIPTION OF THE PREFERRED EMBODIMENT

Figure 1:
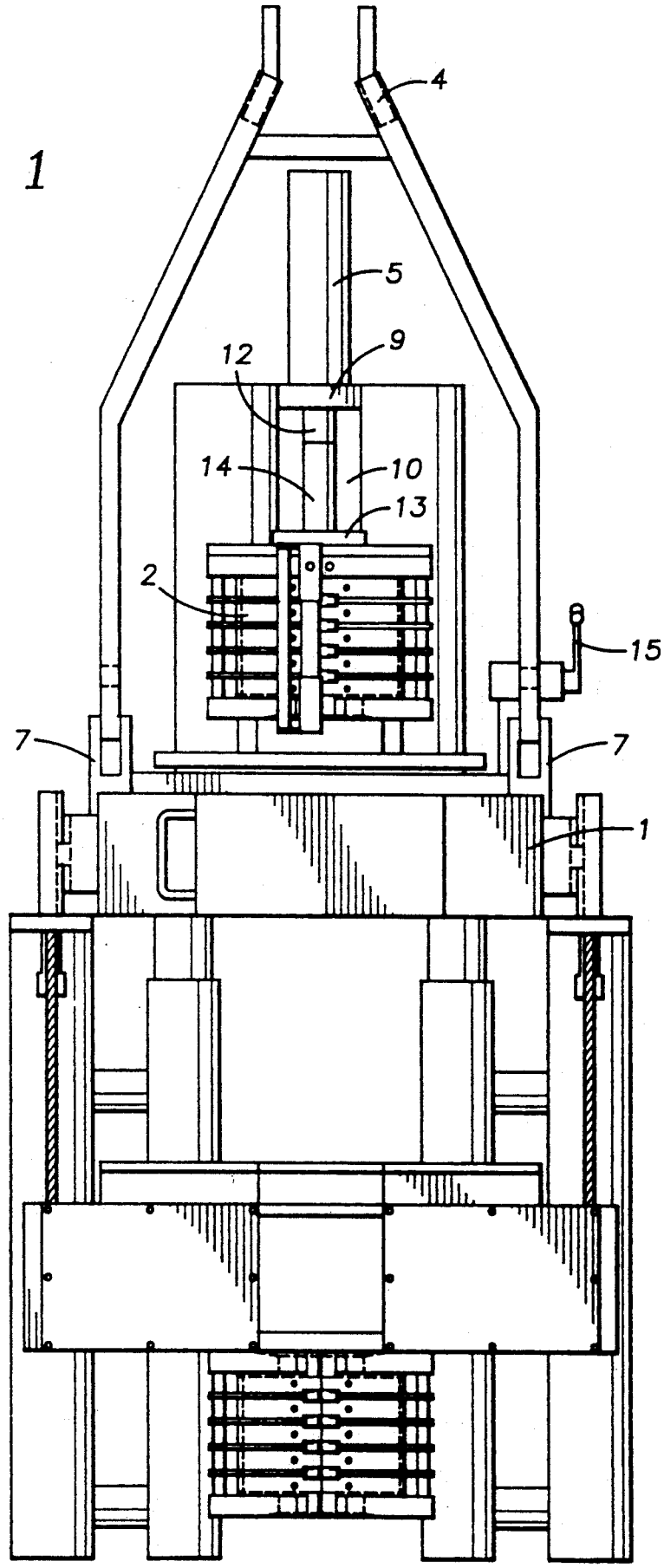
FIG. 1 is a front elevation of a set of tongs mounted with the actuator.
Figure 3:
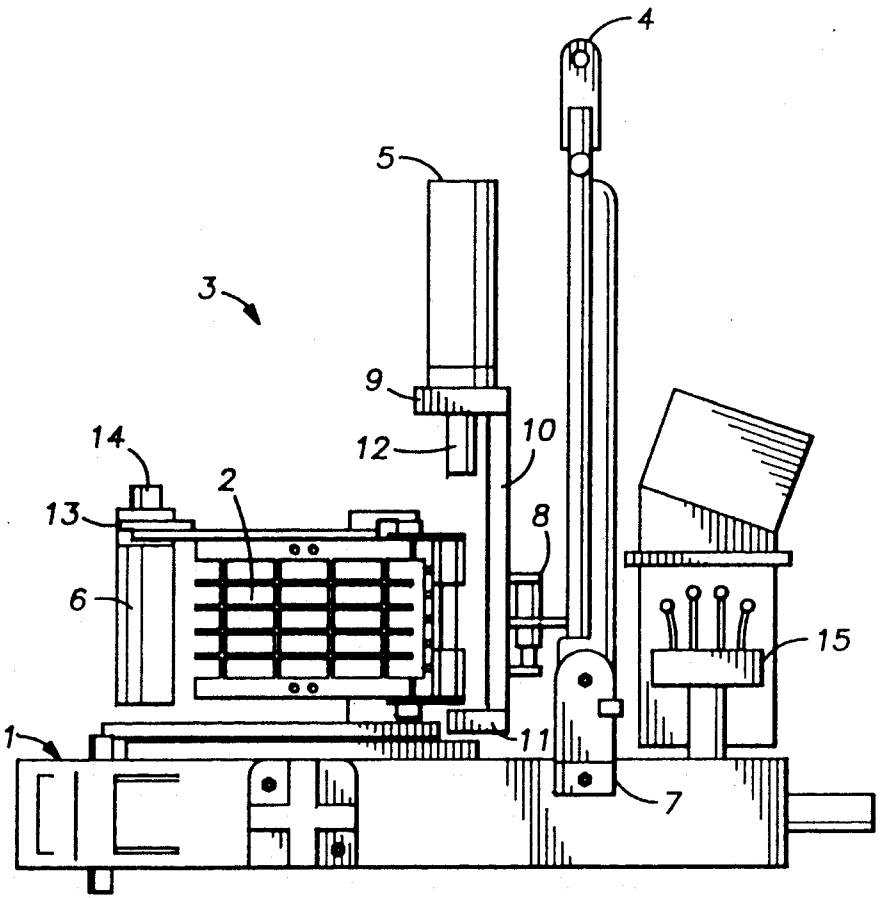
FIG. 3 is a side elevation of the actuator of the present invention showing rotation of the gripping apparatus 180° from that of FIG. 2.
Figure 2:
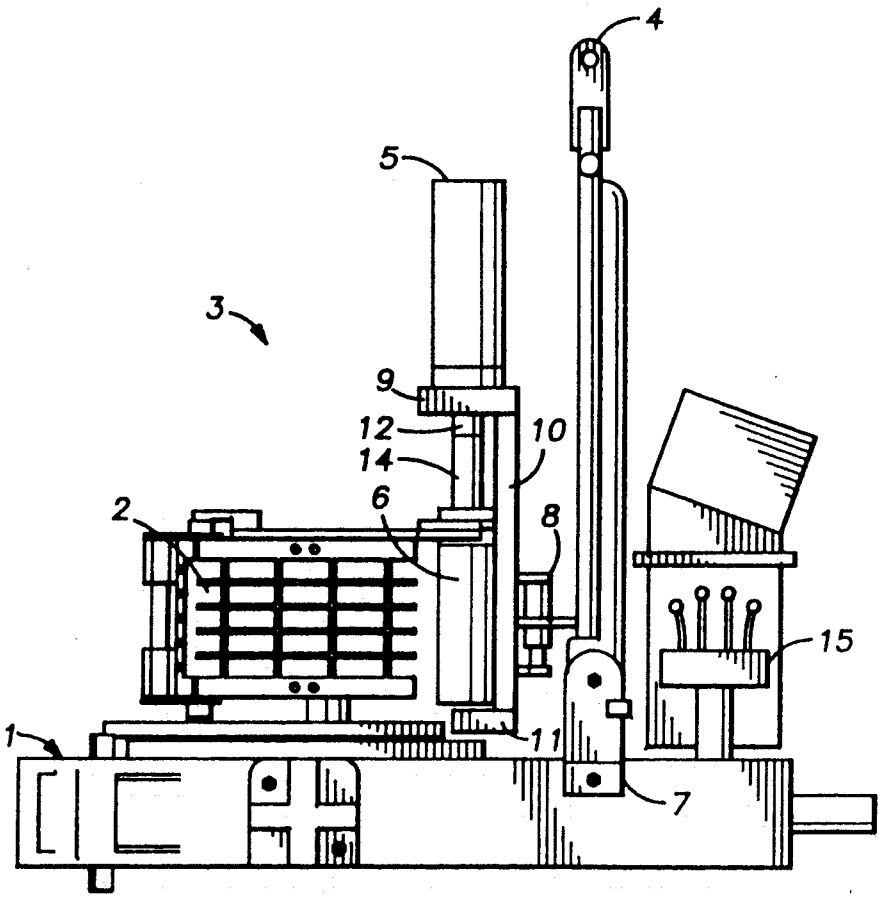
FIG. 2 is a side elevation of the actuator of the present invention mounted on the lead tong of the set of power tongs of FIG. 1.

Referring firstly to FIGS. 1, 2 and 3 there is illustrated the actuator of the present device mounted to the upper tong or lead tong of the power tongs device such as that described in U.S. Pat. No. 4,989,909 filed on Oct. 19, 1990 entitled Improved Torque Transfer Apparatus (U.S. Ser. No. unknown) hereby fully incorporated by reference for all it discloses.

Referring to FIGS. 1, 2 and 3 there are illustrated as indicated generally by the reference numeral 3 components comprising in part the actuator of the present invention. The gripping element which will be described in further detail later is indicated generally by the numeral 2 in all the drawings. A suitable exemplary embodiment gripping device is disclosed in U.S. Pat. No. 4,989,909 hereby fully incorporated by reference. The center line of the gripping element is indicated as CL. Rigidly secured to the body of the lead tong 1 is a strap 4 for suspending and manipulating the tongs. Elements of the actuator comprise a first hydraulic cylinder 5 and a second hydraulic cylinder 6. The first hydraulic cylinder 5 is rigidly secured to the lead tong 1, either to the body of the tong, or as illustrated to the strap 4, which is rigidly secured to the body of the tong at 7, by a suitable bracket arrangement or cage 8. The cage 8 further comprises a mount for the first cylinder 5 which can be configured as shown with a first horizontal plate component 9 bored or otherwise provided with an opening through which the piston or ram 12 of the first cylinder may project (for reasons that will be explained further below). A vertical plate or bar 10 is fastened to the bracket means 8 and to the plate 9 as shown to secure a cylinder mounted to the plate 9 to the tong apparatus. The bracket arrangement may further be provided with a second horizontal plate 11 secured to the lower end of the plate or bar 10 to form a cage, the purpose of which will be explained further below.

Also mounted to the tong body 1 is a gripping device 2. As described above and in the referenced patents the gripping device is rotated about the axis or centerline CL by suitable means to turn or apply torque to any body or workpiece gripped, relative to the tong body 1 which remains stationary. A second bracket 13 is fixed to the gripping device 2 or otherwise mounted to rotate with the gripping device about CL. The bracket 13 like the plate 9 is configured to secure a hydraulic cylinder, in this case cylinder 6, and to allow the end of the piston 14 of the cylinder 6 to extend through the bracket. Therefore as illustrated in FIGS. 1 and 2, the described configuration allows rotation of the gripping device 2, the bracket 13, and the second hydraulic cylinder 6 relative to the tong body 1, bracket 8 (with components 9,10,11), and first hydraulic cylinder 5. The described configuration also allows alignment of the first cylinder 5 and its piston 12 longitudinally with the second cylinder 6 and its piston 14 so that when the pistons are aligned as in FIG. 1 the ends of the pistons 12 and 14 will abut and extension of one piston will compress the other. The function of the plate 11 of the cage or bracket 8 is thus to provide a backstop against a reaction from force exerted by piston 12 against piston 14 to prevent unwanted eccentric loading on the bearing or bearings provided for the rotating gripping device 2. Although a single illustrative configuration for the brackets and cylinders has been described and illustrated, the invention is not to be considered limited thereto and alternative configurations may be fully consistent with the scope of the invention whose function and operation will be described further below.

Figure 4:
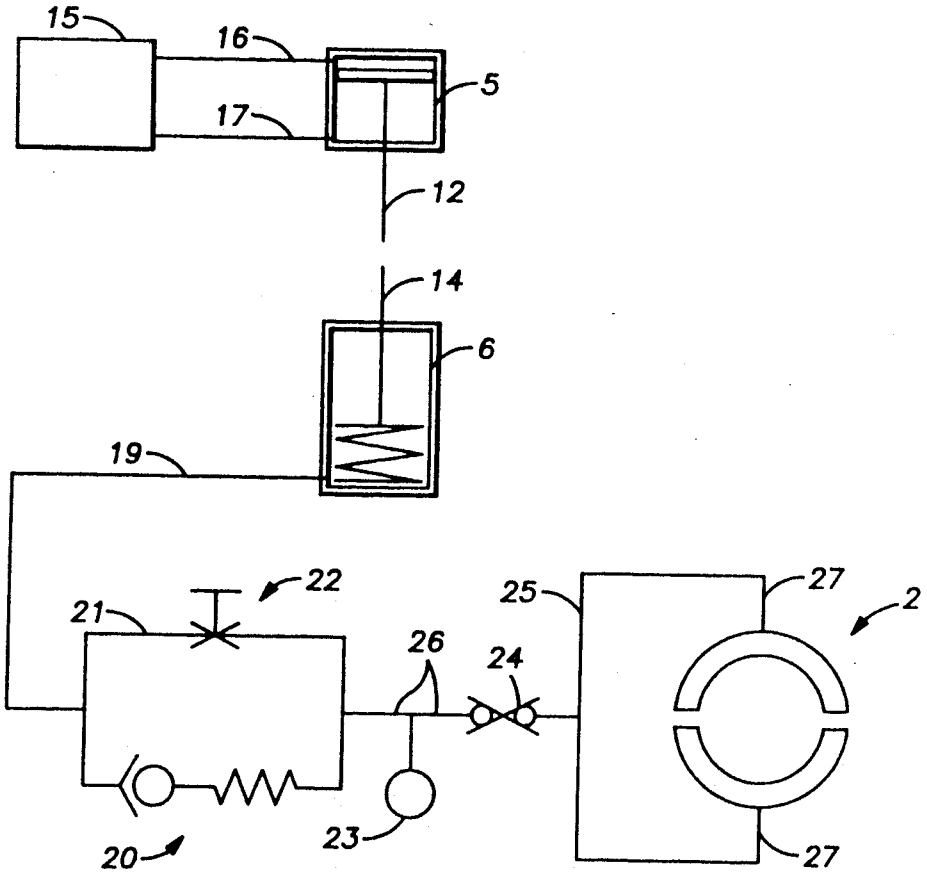
FIG. 4 is a schematic diagram of the present invention.

FIG. 4 illustrates a schematic of the hydraulic flow and components of the present invention. Illustrated in FIG. 3 are: master hydraulic cylinder 5; piston 12; slave hydraulic cylinder 6; piston 14; internal spring 18; a hydraulic power source or valve bank 15 (also shown in FIGS. 1 and 2); hydraulic lines 16, 17, 19, 21, 26, and 25; check valve 20; valve 22; pressure gauge 23; quick connect hydraulic connection 24; and hydraulic inlets 27 to the gripping device 2.

For the best mode of the invention described cylinder 5 is a double acting ram unit or cylinder. Slave cylinder 6 is a single acting ram. As mentioned and illustrated, cylinder 6 is fitted internally with a spring 18 which in the absence of external forces urges piston 14 to extend. The capacity of the slave cylinder and the strokes of the two cylinders are engineered to be compatible with each other and to deliver a sufficient volume and pressure of fluid to the gripping device, whatever its configuration, to operated the device as necessary. The hydraulic power sources commonly available with power tong devices have a range of approximately 2500 p.s.i. maximum, and as with the improved gripping device of U.S. Pat. No. 4,989,909, some gripping devices may require higher pressures to achieve the necessary torque for application to the workpiece. In these cases the diameters of the two cylinders can also be proportioned to multiply the fluid pressure at the same time the force is transferred across the physical boundary from one cylinder to the other. The multiplication is achieved by an application of the principal of the hydraulic press, in sizing the master cylinder and piston of greater diameter than the slave cylinder and piston so that to counteract the force applied by the master piston the slave piston must have a proportionately greater fluid pressure acting against it. The best mode of the operative embodiment illustrated approximately doubles the available fluid pressure from—for example approximately 2500 to approximately 5000 p.s.i.

For the best mode of the invention the check valve, bypass circuit valve, and pressure gauge 23 should be rated for suitable capacity depending upon fluid pressures expected which as mentioned above can be appropriately designed depending upon the fluid pressure necessary to generate a given gripping force. The illustrated quick connect and any others desirable which may be located appropriately for a given application allow rerouting of the hydraulics to enable purging air if a line or seal is blown or if replacement of any component is necessary in the field.

Figure 5:
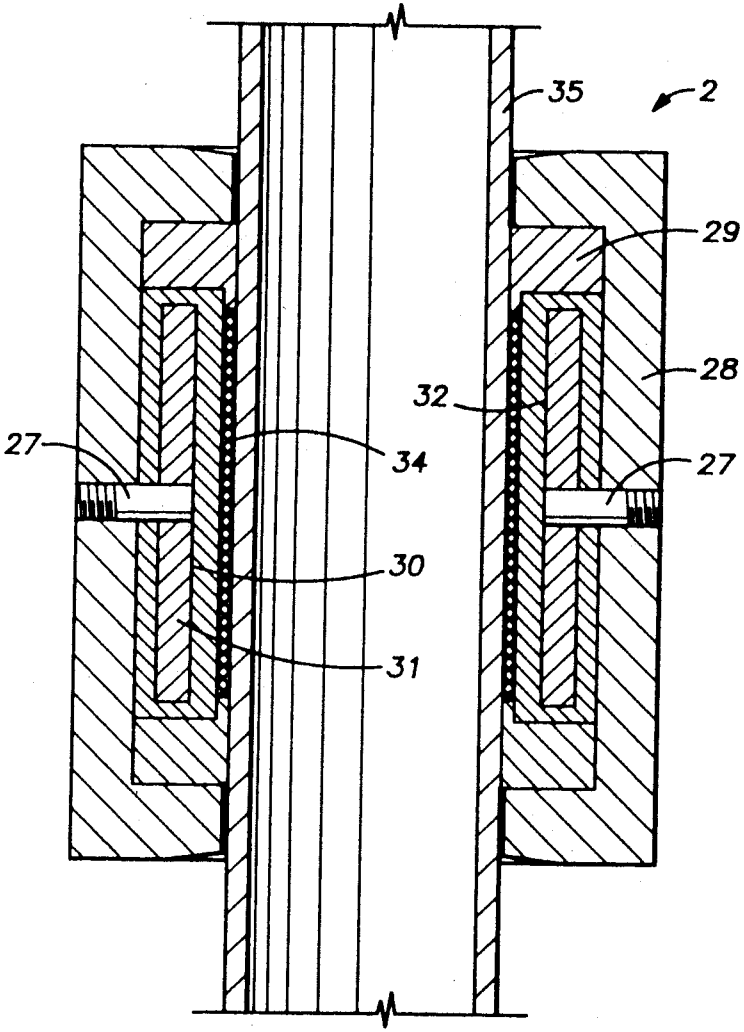
FIG. 5 is the cross-section of a gripping device as used with the present invention.

Referring now to FIG. 5, also provided in accordance with the present invention is an illustrative gripping device 2 for use with the actuator 3 which device may be placed around the outer circumference of a pipe 35 or other cylindrical object which is to be gripped. An annular shaped bladder 32 is formed within a flexible liner 30 which is carried within an outer shell 28 designed to be fastened around and against a cylindrical object such as pipe 35. Introduction of fluid under pressure into the annular shaped bladder 32 via the inlets 27 causes the flexible liner 30 to expand radially inward and to grip the pipe. Movable anti-extrusion rings 29 at the extremes of the flexible liner 30 prevent deformation of the flexible liner into an any annular gap existing between the work piece 35 and the outer shell 28. A thin flexible friction liner or coating 34 may be used on the radially inward face of the flexible liner to extend the service life of the flexible liner.

METHOD OF USING THE PREFERRED EMBODIMENT

The use of power tongs in general is described in the referenced patents. The actuator 3 of the present invention is mounted to the upper tong of a set of tongs to provide a means for pressurizing the gripping device which rotates without requiring hydraulic lines to be disconnected to permit rotation of the gripping device and workpiece. The housing of the gripping device is closed and latched with correct tube, spacers and friction material about the workpiece or pipe 35. Next the master cylinder 5 and slave cylinder 6 are aligned as in FIG. 1 so that the pistons 12 and 14 will abut for proper engagement as the piston 12 of the upper cylinder 5 is extended. The valve 22 is closed and the master cylinder 5 is energized by supplying pressurized hydraulic fluid to the cylinder 5 via the valve bank 15 through line 16. The ram 12 extends and due to the alignment with piston 14, piston 14 is injected into the body of the slave cylinder 6 against the force or urging of the spring 18, and as the piston 14 is injected it compresses spring 18 and forces fluid within the cylinder 6 through line 19 past check valve 20 through line 26 past pressure gauge 23 and connect 24 through line 25 and the inlets 27 into the bladder annulus 32. The expansion of the bladder radially inwardly forces the lining 34 against and grips the pipe 35 enabling application of high torque forces. The pressure gauge 23 provides a reading of the pressure within the bladder and allows calculation of the torque capability, or conversely a reverse calculation will allow for pressurizing the system to a desired pressure to achieve a given torque requirement or ceiling.

After energizing the master cylinder to grip the workpiece as just described, the check valve 20 will prevent the loss of pressure from the gripping device 2 until the bypass valve 22 is opened. Therefore the valve bank 15 can be operated to pressurize line 17 and not line 16 to cause the master cylinder 5 piston 12 to retract for clearance during rotation of the gripping device and workpiece as illustrated in FIG. 2, where the piston 14 is held compressed and the piston 12 is retracted for clearance as the cylinder 6 is rotated about the CL along with the gripping device. The workpiece or pipe 35 can now be rotated or torqued to the desired magnitude since the check valve 20 maintains full pressure to the gripping device.

After the workpiece is torqued or rotated fully, valve 22 is opened, and spring 18 urges piston 14 to extend drawing fluid into the cylinder 6 through line 19 and at the same time acting to withdraw fluid through lines 25 and 26 from the annular bladder 32 to release the grip of device 2. The gripping device can be positioned about the next workpiece, and the cylinders aligned for another sequence of actuating, gripping and torquing.

It is seen that the invention allows actuating or pressuring up a gripping device without requiring connecting a power source that must be disconnected for rotation of the device. The device is simple and easy to operate and repair in the field and accurately allows for achieving a target torque value. Although this device has been described in terms of a specific illustrative enabling hydraulic embodiment it is not to be understood as limited thereto, and various other modifications will occur to those of skill in the art, to create modified embodiments and other uses for the invention. Other fluids could be used to power the actuator, or the principal of separating the power source from the rotating components could be applied mechanically, electrically, or otherwise, inasmuch as the invention is subject to many variations. The foregoing description should be regarded as only illustrative of the invention, whose full scope should be measured by or defined by the appended claims.

What is claimed is:

1. Actuating means for rotatably mounted gripping apparatus comprising:

(a) a fluid supply and pressuring means;

(b) a transmission mechanism means for translating said pressurized fluid into a force moving across a physical boundary and for translating said force back into pressurized fluid once across said boundary, said mechanism comprising:

(i) a first component in fluid communication with said supply comprising a constituent moveable in response to said supply and pressurizing means, (ii) a second component rotatably mounted with said gripping apparatus, said second component comprising a moveable constituent capable of alignment with said moveable constituent of said first component, said second component in fluid communication with said gripping apparatus for actuating said gripping apparatus by fluid pressure generated in response to movement of said second moveable constituent component in response to movement of said first moveable constituent component when said first and second components are aligned and when said first component is supplied with fluid and pressurized.

2. The invention of claim 1 wherein said first and second components comprise first and second hydraulic cylinders and wherein said moveable constituents of said first and second components comprise the piston rams of said first and second hydraulic cylinders.

3. The invention of claim 1 further comprising means for modifying the pressure of said fluid simultaneously with the translations of said fluid pressure into force and back into fluid pressure.

4. The invention of claim 2 further comprising means for modifying the pressure of said fluid simultaneously with the translations of said fluid pressure into force and back into fluid pressure.

5. The invention of claim 4 wherein said means for modifying the fluid pressure during the translations from pressure to force to pressure comprises using different diameters for said first and second hydraulic cylinders.

6. The invention of claim 1 further comprising check valve means and bypass return valve means intermediately mounted within said fluid communication pathway between said component and said gripping apparatus.

7. The invention of claim 4 further comprising check valve means and bypass return valve means intermediately mounted within said fluid communication pathway between said component and said gripping apparatus.

8. The invention of claim 5 further comprising check valve means and bypass return valve means intermediately mounted within said fluid communication pathway between said component and said gripping apparatus.

9. The invention of claim 7 further comprising means for purging said pathways.

10. The invention of claim 9 wherein said purging means comprises hydraulic quick disconnects.

11. The invention of claim 8 further comprising means for purging said pathways.

12. The invention of claim 11 wherein said means for purging comprises hydraulic quick disconnects.

13. Actuating means for rotatably mounted gripping apparatus comprising:

(a) signal means;

(b) transmission means for translating said signal means across a physical boundary comprising:

(i) a first component in communication with said signal means comprising a constituent movable in response to said signal means;

(ii) a second component rotatably mounted with said gripping apparatus, said second component comprising a movable constituent capable of alignment with but not connected to said movable constituent of said first component, and said second component in communication with said gripping apparatus for actuating said gripping apparatus in response to movement of said second moveable constituent component in response to movement of said first moveable constituent component when said first and second components are aligned, and when said movable constituent of said first component is moved in response to said signal means.

14. The invention of claim 13 further comprising releasable checking means to maintain the gripping force of said gripping apparatus even upon cessation of said signal means.

* * * * *